US006125931A

United States Patent [19]

Hult et al.

[11] Patent Number: 6,125,931

[45] Date of Patent: Oct. 3, 2000

[54] RIGHT ANGLE DRIVE ADAPTER FOR USE WITH A VERTICAL DRIVE HEAD IN AN OIL WELL PROGRESSING CAVITY PUMP DRIVE

[75] Inventors: Vern Arthur Hult; Curtis Christopher Blundell, both of Calgary, Canada

[73] Assignee: Weatherford Holding U.S., Inc., Houston, Tex.

[21] Appl. No.: 09/106,632

[22] Filed: Jun. 29, 1998

[51] Int. Cl.[7] ..... E21B 43/00

[52] U.S. Cl. ..... 166/68.5; 166/77.51

[58] Field of Search ..... 166/68, 68.5, 72, 166/77.51

[56] References Cited

U.S. PATENT DOCUMENTS

| | | | |
|---|---|---|---|
| 4,716,961 | 1/1988 | Makins, Jr. et al. | 166/68.5 |
| 5,143,153 | 9/1992 | Bach et al. | 166/68.5 |

*Primary Examiner*—William Neuder

*Attorney, Agent, or Firm*—Hayes, Soloway, Hennessey, Grossman & Hage, P.C.

[57] ABSTRACT

A right angle drive adapter for use with an oil well vertical drive head having a drive head housing and an input shaft rotatably mounted in and extending axially outwardly of the drive head housing. The adapter comprises an adapter housing removably securable to the drive head housing in axial alignment therewith, an input shaft mounted in the adapter housing for rotation therein and for removable attachment to a rotary source of power, an output shaft mounted in the adapter housing for rotation therein at substantially a right angle to the input shaft, the output shaft having a socket for telescopically receiving and drivingly connecting to the drive head input shaft; and a gearset mounted in the housing for drivingly connecting the input and output shafts. The adapter allows the installation of a vertical drive head and a gas engine to be used for driving the drive head before electrical power is available. When electrical power becomes available, the adaptor is removed and the gas engine is replaced by an electric motor which is connected directly to the drive head.

8 Claims, 4 Drawing Sheets

RIGHT ANGLE DRIVE ADAPTER FOR USE WITH A VERTICAL DRIVE HEAD IN AN OIL WELL PROGRESSING CAVITY PUMP DRIVE

The present invention relates, in general, to oil well equipment and, more specifically, to a right angle drive adapter for use with a vertical drive head in an oil well progressing cavity pump system.

BACKGROUND OF THE INVENTION

It is well known that oil is extracted from the ground by drilling a hole and installing a steel casing into the hole. Oil well holes may be several thousand feet deep and specialized pumps, known as Progressing Cavity pumps, are required to generate the high pressures necessary to pump the oil to the surface. The pumps are located at the bottom of the hole and driven by a drive string typically comprised of sucker rods which are connected together in end-to-end relation. Large electric motors and vertical drive heads are the preferred mode of driving the drive string.

In the current state of the art, manufacturers sell right angle drives as well as vertical drives. In a vertical drive, the input torque is parallel to the vertical axis of rotation of the drive string. In a right angle drive, the input torque is horizontal and perpendicular to the axis of the drive string and, therefore, gearing is required to convert horizontal torque to vertical torque. Both drives typically include a backspin speed reduction brake and thrust bearing arrangement.

Electrical power is frequently not available when an oil well is first put into service and, therefore, it is not possible to use an electric motor at the outset. Accordingly, it is customary to use a skid mounted gas engine to drive the pump. This requires the installation of a right angle drive head on the wellhead frame. When electrical power becomes available, the gas engine is replaced by an electric motor with a right angle motor mounting system in order to connect to the original right angle drive mechanism. The original right angle drive is retained to avoid purchasing a replacement vertical drive.

The problem with this approach is that right angle drives are more expensive and break down more frequently than vertical drives resulting in a loss of production. Furthermore, typical right angle drive heads are supplied with speed reduction ranging between 2:1 and 5:1 and these drives are not capable of the same high speed range as vertical drive heads. For example, a typical 2:1 right angle drive is rated at 400 rpm. Initially, the speed requirement is relatively low and there is no problem. When electrical power becomes available, the gas engine is replaced by an electric motor. As the well matures, water breaks through the oil and the pump speed must be increased to as much as 500 rpm in order to maintain the same oil production while pumping large volumes of water. Under these conditions, the original 2:1 drive is required to operate above its 400 rpm rating. This causes excessive lubrication oil temperatures, noise and premature wear, all leading to early drive head failures. While this is clearly an undesirable situation, no effective alternative has thusfar been proposed.

SUMMARY OF THE INVENTION

The present invention seeks to provide a system which provides the necessary right angle drive for use with a gas engine but which allows a vertical drive to be used as soon as electric power became available. To that end, the present invention provides a relatively inexpensive right angle drive adapter which fits on top of and connects to the input shaft of a standard vertical drive head for driving by a gas engine. Thus, the adapter allows the preferred vertical drive to be installed when the well is initially installed, but allows a gas engine to be used until electric power becomes available. Once electric power is available, the user simply removes the right angle drive adapter and installs an electric motor with a vertical drive mounting system. The adapter can then be used elsewhere on another temporary gas engine installation. The user benefits by having the optimum drive system for long term production. The right angle drive adapter is relatively inexpensive since it consists only of a right angle drive gearset without an over speed protection mechanism and thrust bearing assembly which are necessary in a complete right angle drive head.

The present invention is broadly defined as a right angle drive adapter for use with a vertical drive head having a housing and an input drive shaft, the adapter comprising an adapter housing arranged to be removably secured to the vertical drive head housing, an input shaft rotatably mounted in the adapter housing and extending outwardly therefrom for connection to a rotary source of power, an adapter drive shaft rotatably mounted in the adapter housing for rotation therein at a right angle to the input shaft, gear means drivingly connecting the input shaft and the drive shaft and the drive shaft being tubular for receiving the drive shaft of the vertical drive head and means for drivingly connecting the adapter drive shaft to the vertical drive head drive shaft.

BRIEF DESCRIPTION OF THE DRAWINGS

These and other features of the invention will become more apparent from the following description in which reference is made to the appended drawings in which.

DETAILED DESCRIPTION OF A PREFERRED EMBODIMENT OF THE INVENTION

Figure 1:
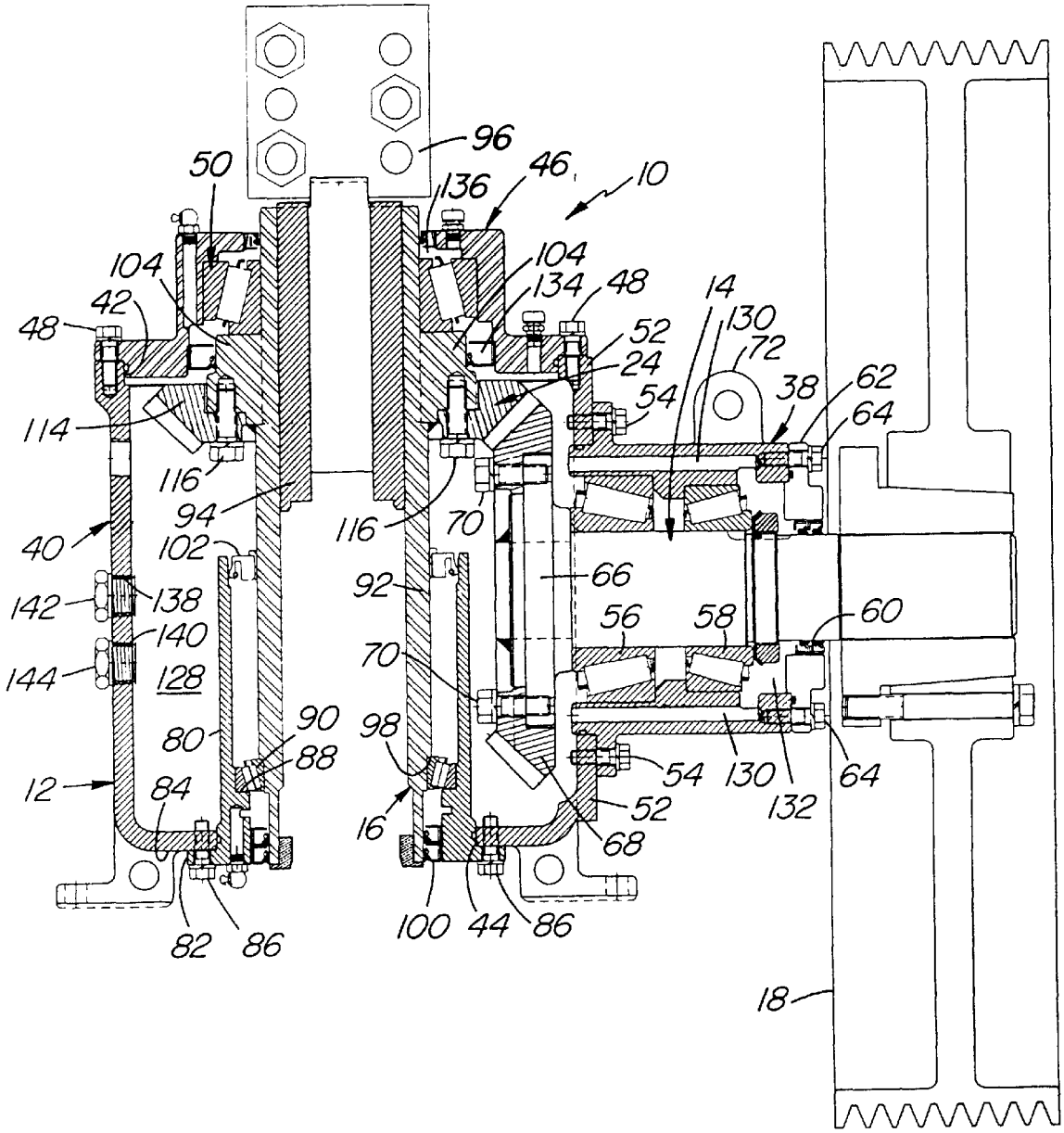
FIG. 1 is a longitudinal cross-sectional view illustrating a preferred embodiment of the right angle drive adapter of the present invention.

Referring to FIG. 1, the right angle drive adapter is generally designated by reference numeral 10. The adapter includes a housing 12, an input shaft 14 and an output shaft assembly 16. The input shaft is mounted in the housing for rotation, during operation, about a horizontal axis and extends outwardly of the housing for removable, driving connection to a driven sheave 18. The output shaft assembly is mounted in the housing for rotation about a vertical axis, i.e. at right angles to the axis of the input shaft, and is adapted to be removably connected to the input drive shaft 20 of a vertical drive head 22 (see FIG. 2). The two shafts are drivingly connected together by a bevel gearset 24 which provides a 1:1 drive ratio.

Figure 2:
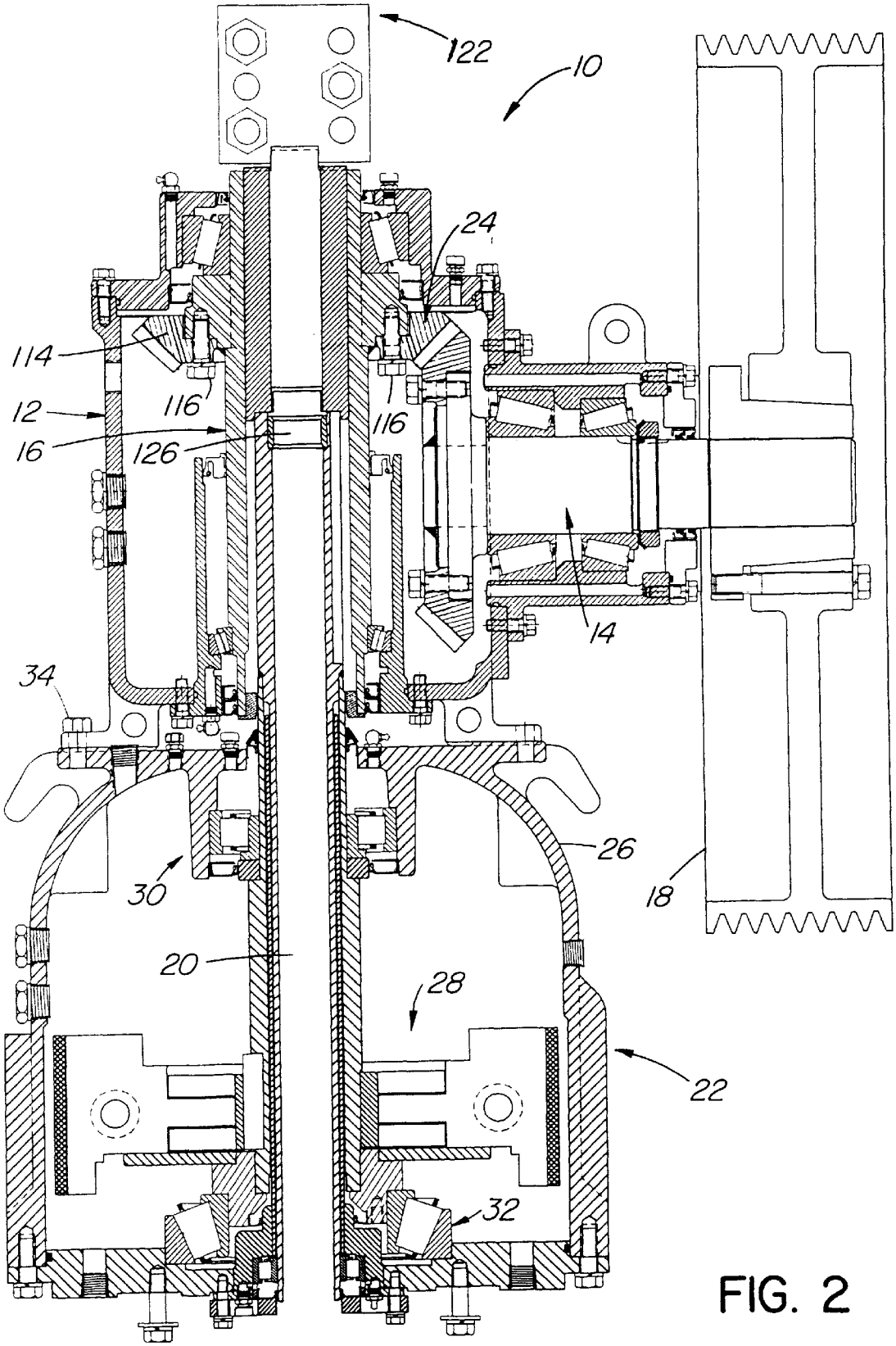
FIG. 2 is a longitudinal cross-sectional view illustrating similar to FIG. 1, but illustrating the right angle drive adapter operatively connected to a vertical drive head.

FIG. 2 illustrates the right angle drive adapter operatively mounted on vertical drive head 22. The drive head is described and claimed in Applicant's co-pending U.S. patent application Ser. No. 09/076,188, filed on May 11, 1998 and which is incorporated herein by reference. For the purposes of this description, the drive head 22 will be seen to include a housing 26 which houses a backspin retarder assembly 28 and upper and lower bearing assemblies 30 and 32 which support drive head input shaft 20. Shaft 20 extends vertically upwardly and outwardly of drive head housing 26 into output shaft assembly 16, as described more fully later. It will also be noted that adapter housing 12 is connected to drive head housing 26 by a series of bolts 34, so that installation and removal of the adapter is a relatively simple process which requires little down time.

Housing 12 includes two housing portions, an input housing 38, which houses input shaft 14, and a main housing 40, which houses gearset 24 and output drive shaft assembly 16 and which is removably secured to the upper end of the housing 26 of the vertical of drive head by bolts 34, as already mentioned. Main housing 40 is formed with axially aligned upper and lower openings 42 and 44 to permit passage of drive shafts therethrough, as explained more fully later. A removable cover 46 is secured to the upper end of housing 40 by bolts 48. A bearing assembly 50 is mounted in the cover for output drive shaft assembly 16.

Input housing 38 is secured to a flange 52 formed on the right side of the housing 40, as viewed in FIG. 1, by bolts 54. A pair of axially spaced roller bearings 56 and 58 are mounted in input housing 38 for rotatably supporting input shaft 14. Shaft 14 extends though a sealed opening 60 in an input housing cover 62 which is secured to input housing 38 by bolts 64. The outer end of shaft 14 is removably and drivingly secured to sheave 18 for rotation therewith. The inner end of shaft 14 extends into the main housing 40 and is formed with a hub 66 to which a drive bevel gear 68 of gearset 24 is connected by bolts 70. Input housing 38 is provided with lugs 72 to facilitate installation and removal of the adapter onto and from the vertical drive head.

A standpipe 80 extends though opening 44 in the main housing and defines the vertical axis in the main housing. A flange 82 at the bottom end of the standpipe abuts the underside 84 of the main housing and is secured thereto by bolts 86. An upwardly facing shoulder 88 in the standpipe supports the outer race of a roller bearing 90.

Output shaft assembly 16 is comprised of three components, namely, a main shaft 92, a tubular drive shaft 94, telescopically received within main shaft 92, and a clamp 96 for drivingly securing shafts 92 and 94 together. Main shaft 92 is coaxially mounted in the standpipe and formed with an annular, downwardly facing shoulder 98 which is seated on the inner race of bearing 90. The lower end of shaft 92 terminates proximate the lower end of the standpipe in a seal 100. The main shaft extends upwardly and outwardly of the standpipe through a seal 102.

Figure 4:
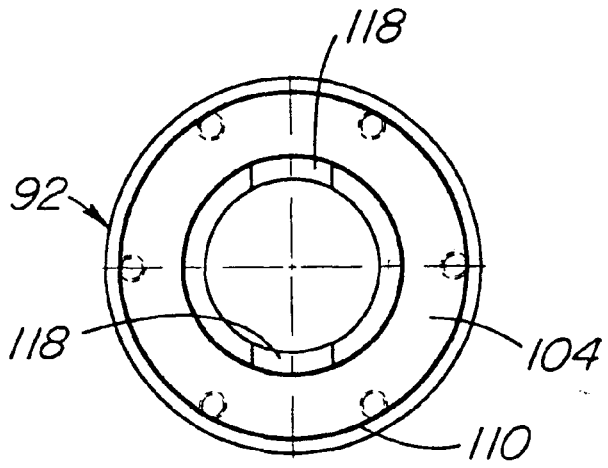
FIG. 4 is an end view of the upper end of the main shaft illustrated in FIG. 1.
Figure 3:
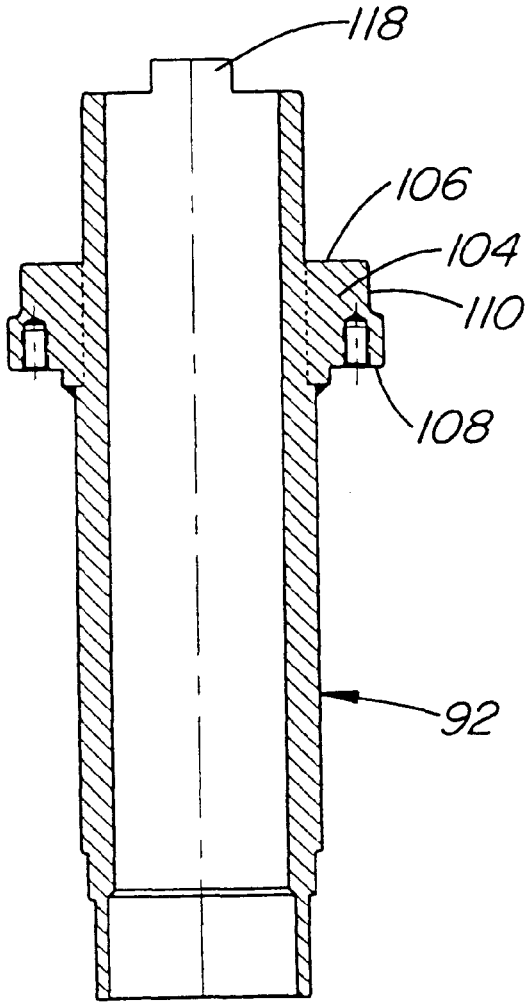
FIG. 3 is a longitudinal cross-sectional view of a main shaft according to a preferred embodiment of the present invention.

FIGS. 3 and 4 illustrate main shaft 92 in more detail. The upper end of the shaft is formed with a flange 104 which defines an upwardly facing annular shoulder 106, a downwardly facing shoulder 108 and a cylindrical seal surface 110. Shoulder 106 abuts the inner race of upper bearing assembly 50, the outer race of which is mounted in housing cover 46. Shoulder 108 abuts a mating shoulder formed on a driven bevel gear 114 which is secured to flange 104 by bolts 116 and which meshes with drive bevel gear 68. The uppermost end of the main shaft is formed with a pair of diametrically opposed, longitudinal lugs 118.

Figure 6:
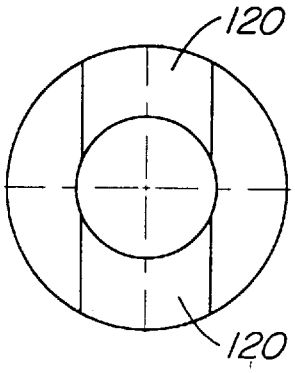
FIG. 6 is an end view of the upper end of the drive shaft illustrated in FIG. 5.
Figure 5:
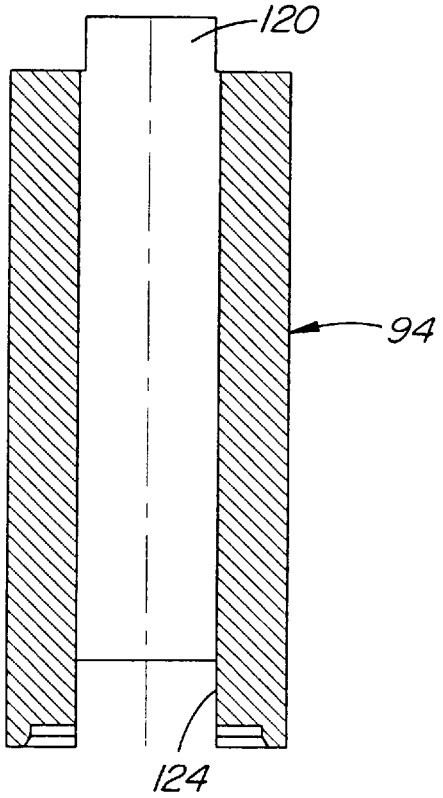
FIG. 5 is a longitudinal cross-sectional view of a drive shaft according to a preferred embodiment of the present invention.
Figure 7:
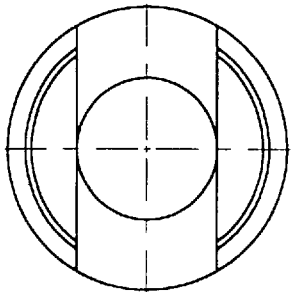
FIG. 7 is a end view of the bottom end of the drive shaft illustrated in FIG. 5.

Tubular drive shaft 94 is telescopically received within the tubular main shaft. Shaft 94 is illustrated in more detail in FIGS. 5–7. As with main shaft 92, drive shaft 94 is formed with a pair of longitudinally extending, diametrically opposed lugs 120 which are aligned with lugs 118. The two pairs of lugs are secured together by a clamp 122. The lower end of drive shaft 94 is formed with a pair of diametrically opposed recesses 124 for receiving mating projections 126 extending from the upper end of the drive head shaft 20.

The main housing, standpipe, main shaft and input housing and seals therebetween define a fluid chamber 128. Input housing 38 is formed with a plurality of longitudinal holes 130 which extend from the inner end of the input housing, where the holes open into chamber 128, to a chamber 132 defined by the outer side of the bearing assembly 58 and input housing cover 62. The level of the fluid in chamber 128 is approximately equal to the height of the axis of the input shaft and the drive gear above the bottom of the housing and below the upper end of the standpipe. Seal 134 defines a boundary between fluid chamber 128 and a grease cavity 136 in the main housing cover 46 and in which bearing 50 is located. A pair of oil filling and inspection ports 138 and 140, with access nuts 142 and 144 are formed in the main housing.

It will be seen from the foregoing that right angle drive adapter of the present invention is of relatively simple and inexpensive construction and can be easily installed onto and removed from a vertical drive head. Thus, the adapter permits the use of the desired vertical drive head when initially constructing the oil well hole and installing the pump drive string, the use of a gas engine when electrical power is not available and the substitution of an electric motor for the gas engine when electrical power becomes available.

In addition, the construction described above is such that belt pull forces are transmitted to the vertical drive head shaft without putting a bending load onto the shaft. This is achieved because the loads are effectively transferred to the adapter housing and then to the drive head housing and the moment arm is relatively short. Thus, any bending moments applied to the drive head shaft are kept to a minimum.

It will be understood that various modifications and alterations may be made to the above described invention without departing from the spirit of the invention as defined by the appended claims.

What is claimed is:

1. A right angle drive adapter for use with an oil well vertical drive head, said drive head having a drive head housing and an input shaft rotatably mounted in and extending axially outwardly of said drive head housing, said adapter comprising:

an adapter housing removably securable to said drive head housing in axial alignment therewith;

an adapter input shaft mounted in said adapter housing for rotation therein and for removable attachment to a rotary source of power;

an adapter output shaft mounted in said adapter housing for rotation therein at substantially a right angle to said input shaft, said output shaft having a socket for telescopically receiving and drivingly connecting to said drive head input shaft;

drive means mounted in said housing for drivingly connecting said input and output shafts; and a standpipe secured to and extending inwardly of said adapter housing for preventing lubricating oil in said housing from being lost form the bottom thereof, said output shaft being coaxially disposed an mounted in said standpipe for rotation therein.

2. A right angle drive adapter as defined in claim 1, said output shaft including a first and second tubular shaft members, said second member being telescopically received within said first member and being secured to said first member proximate one end thereof, said second member being a shorter than said first member so as to define said socket for receiving said drive head input shaft.

3. A right angle drive adapter as defined in claim 2, said second member having receptacles for receiving mating axial projections on said drive head shaft for drivingly engaging said second member and said drive head shaft.

4. A right angle drive adapter as defined in claim 2, a portion of each said tubular shaft members extending axially outwardly of said housing, said portions being bifurcated defining longitudinal lugs, further including clamp means secured to said portions proximate said lugs for securing said first and second shaft members together.

5. A right angle drive adapter as defined in claim 2, said second member projecting above said output shaft for preventing vertical loads from being imposed on said adapter.

6. A right angle drive adapter as defined in claim 1, said output shaft being engageable with said drive head input shaft in a predetermined angular position for preventing misalignment of said adapter and said drive head and associated loads resulting from misalignment of said shafts from being transmitted to bearings in said adapter.

7. A right angle drive adapter as defined in claim 1, said output shaft having an annular, radially outwardly extending flange defining upper and lower annular shoulders and a cylindrical seal seating surface connecting said shoulders, said upper surface being abuttingly engageable with a bearing and said lower shoulder being engageable with a mating surface of said second bevel gear.

8. A right angle drive adapter for use with an oil well vertical drive head in an oil well progressing cavity pump system, said drive having a drive head housing and an input shaft ratably mounted in and extending axially outwardly of said drive head housing, said adapter comprising:

a main housing having axially aligned openings at opposite ends thereof and an opening in one side thereof;

an input housing secured to said main housing about said opening in said one side, an adapter input shaft mounted in said input housing for rotation therein, drive means secured to the outer end of said adapter input shaft for ratably driving said drive head input shaft, a first bevel gear secured to an inner end of said adapter input shaft for rotation therewith;

a standpipe secured to and extending inwardly of said main housing, an output shaft coaxially disposed and mounted in said standpipe for rotation therein;

said output shaft including a tubular main shaft having one end coaxially mounted in said standpipe for rotation therein, said main shaft extending axially outwardly of said standpipe toward the other of said aligned openings, a second bevel gear drivingly secured to said main shaft and meshingly engaged with said first bevel gear; and a tubular drive shaft telescopically received within and secured to one end of said main shaft.

* * * * *